United States Patent [19]

Murase

[11] Patent Number: 4,722,707

[45] Date of Patent: Feb. 2, 1988

[54] TRANSMISSION FOR SMALL BOAT

[75] Inventor: Masaaki Murase, Futamate, Japan

[73] Assignee: Kawasaki Jukogyo Kabushiki Kaisha, Kobe, Japan

[21] Appl. No.: 821,265

[22] Filed: Jan. 22, 1986

[30] Foreign Application Priority Data

Jan. 23, 1985 [JP] Japan ..... 60-11548

[51] Int. Cl.[4] ..... B63H 11/00

[52] U.S. Cl. ..... 440/38; 440/83; 440/112

[58] Field of Search ..... 440/38, 75, 83, 111, 440/112

[56] References Cited

U.S. PATENT DOCUMENTS

| | | | |
|---|---|---|---|
| 3,083,680 | 4/1963 | Willis et al. | 440/83 |
| 3,138,010 | 6/1964 | Shipley et al. | 440/83 |
| 3,369,518 | 2/1968 | Jacobson | 440/38 |
| 4,344,630 | 8/1982 | Veres | 440/112 |

FOREIGN PATENT DOCUMENTS

| | | | |
|---|---|---|---|
| 75793 | 6/1977 | Japan | 440/83 |
| 1030259 | 7/1983 | U.S.S.R. | 440/83 |

*Primary Examiner*—Joseph F. Peters, Jr.
*Assistant Examiner*—Stephen P. Avila
*Attorney, Agent, or Firm*—Marshall, O'Toole, Gerstein, Murray & Bicknell

[57] ABSTRACT

This disclosure relates to a transmission for a small boat including a hull, an engine mounted on the hull, the engine having a crankshaft, and an impeller having an impeller shaft journaled by the hull. The transmission includes an intermediate shaft positioned between the crankshaft and the impeller shaft, a pair of coupling joints angularly movably connected to both ends of the intermediate shaft and connected to the crankshaft and to the impeller shaft. A bearing is connected to the intermediate shaft between the ends thereof, and a resilient mount is connected to the bearing and mounted on the hull for elastically journaling the intermediate shaft on the hull.

2 Claims, 6 Drawing Figures

TRANSMISSION FOR SMALL BOAT

FIELD AND BACKGROUND OF THE INVENTION

The present invention relates to a pump transmission particularly suited for a small boat including a water jet propeller.

FIG. 1 schematically shows a small boat of the type to which this invention is applicable. The boat includes a hull 28, made, for example, of fiber reinforced plastic, which houses a fuel tank 29 and an engine 1 including a crankshaft 2. The engine 1 drives a water jet propeller 5 which is coupled to the shaft 2 and is supported within a duct 30 formed in the hull adjacent the stern. The propeller 5 includes an impeller shaft 8 supported by an impeller bearing 6 mounted within the duct. The boat has a pump transmission which includes an intermediate shaft 11 interconnecting the crankshaft 2 and the impeller shaft 8 through fore and aft couplings 10 and 10*a*. The intermediate shaft 11 is supported by an intermediate bearing unit 16 mounted on a bulkhead 3 of the hull 28.

FIG. 2 shows in detail a part of a conventional pump transmission used in a boat of the character shown in FIG. 1. In FIG. 2, the forward coupling 10 mounted on the crankshaft 2 of the engine 1 is coupled to the intermediate shaft 11 through an outer sleeve 10*b* and axial splines 12. A similar coupling arrangement is also used at an aft coupling 10*a*. The intermediate shaft 11 is journaled by the intermediate bearing unit 16, which includes a bearing case having an integrally formed sleeve 22 and flange 24 fixed to a bulkhead 3. An inner sleeve 18 and bearings 37 are mounted between the bearing case and the shaft 11.

The intermediate shaft 11 is supported in a fixed position and at a fixed angle by the bulkhead 3. The crankshaft 2 and the impeller shaft 8 are coupled in angularly fixed relation to the intermediate shaft 11. However, since the engine 1 is usually mounted on resilient cushions, the crankshaft 2 is likely to become offset from the axis of the intermediate shaft 11 during operation. However, such an offset is not accommodated or absorbed by this fixed arrangement of the shafts. Also, in the conventional arrangement, since the water jet propeller shown in FIG. 1 is mounted on the hull, the impeller shaft 8 may become offset from the intermediate shaft 11 during operation. However, such an offset is not accommodated because the intermediate shaft 11 is supported in fixed relation to the bearing unit 16.

In order to remedy this situation, laborious shimming adjustments have been necessary when the engine 1 (or the impeller bearing) is mounted.

Furthermore, the fixed arrangement of the intermediate shaft 11 on the bearing unit 16 produces large loads on the connection between the crankshaft 2 and the shaft 11, on the bearing unit 16, and in turn on the bulkhead 3. This may lower the durability of the parts.

SUMMARY OF THE INVENTION

It is a general object of this invention to obviate the foregoing problems and thereby eliminate laborious alignment of the shafts and improve the durability of the parts.

According to this invention, a pump transmission is provided for a small boat including a hull, an engine mounted on the hull and having a crankshaft, and an impeller having an impeller shaft journaled by the hull.

The transmission comprises an intermediate shaft, a pair of joints angularly movably coupling both ends of the intermediate shaft respectively to the crankshaft and to the impeller shaft, and bearing means mounted on the hull for elastically journaling the intermediate shaft.

BRIEF DECRIPTION OF THE DRAWINGS

A preferred embodiment of the invention is described as follows with reference to the accompanying drawings, wherein.

DETAILED DECRIPTION OF THE DRAWINGS

Figure 1:
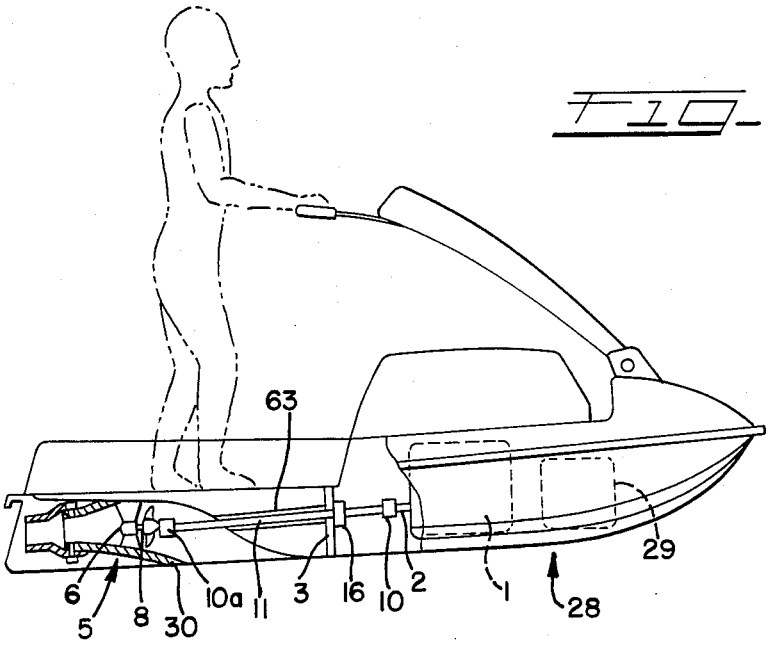
FIG. 1 is a side view partially in section of a small boat, to which the invention is applicable.
Figure 2:
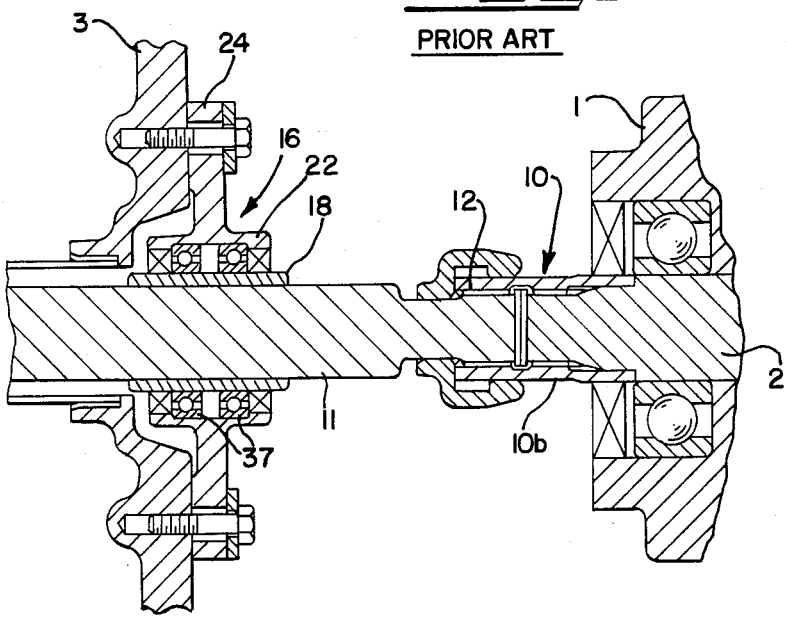
FIG. 2 PRIOR ART
FIG. 2 is a fragmentary view in axial section of a prior art transmission.
Figure 3:
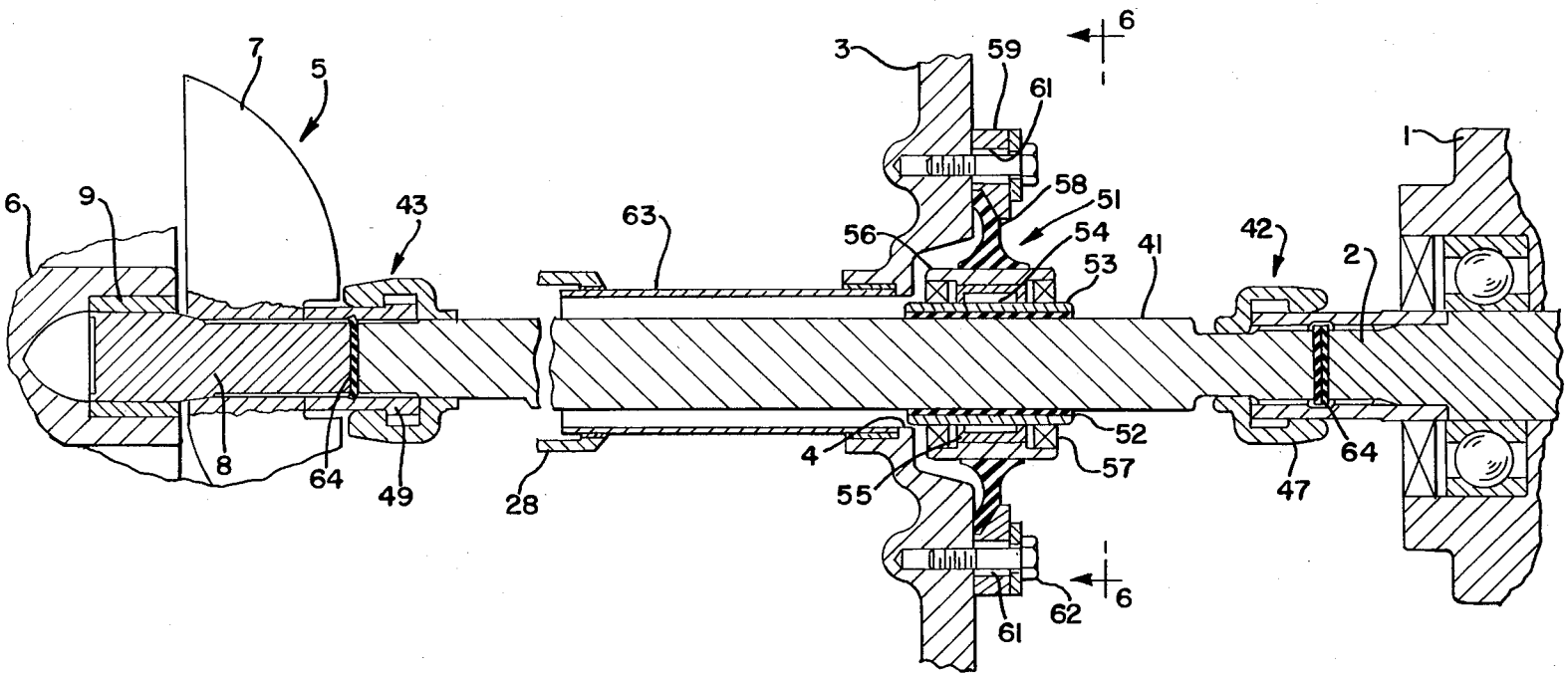
FIG. 3 is a fragmentary view in axial section of a transmission embodying the invention.

With reference to FIG. 3, the engine 1 is mounted with resilient cushions (not shown) on the hull of a boat as shown in FIG. 1. The engine includes the crankshaft 2 having an aft end extending outside the engine, and the hull includes the bulkhead 3 formed with a central hole 4 therethrough.

At the stern, the boat includes a water jet propeller 5 having impellers 7 fastened to a shaft 8, which, in turn, is journaled on a metal sleeve 9 of an impeller bearing 6. The bearing 6 is supported on the hull and is mounted in a duct, such as the duct shown in FIG. 1, formed in the hull.

Connected between the fore end of the impeller shaft 8 and the aft end of the crankshaft 2 are an intermediate shaft 41, a fore coupling joint 42 and an aft coupling joint 43. The joints 42 and 43 are interconnected in driving relation between the shafts.

Figure 4:
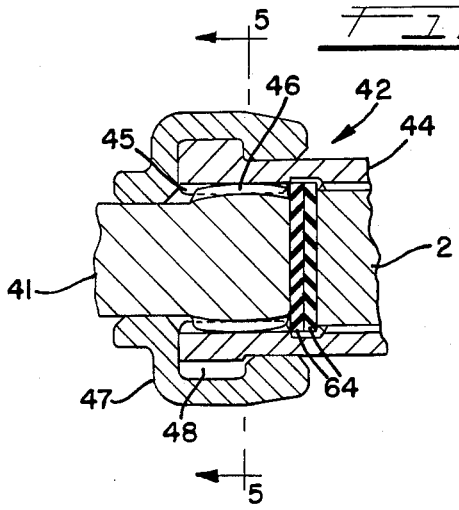
FIG. 4 is an enlarged fragmentary sectional view of a part of the transmission shown in FIG. 1.
Figure 5:
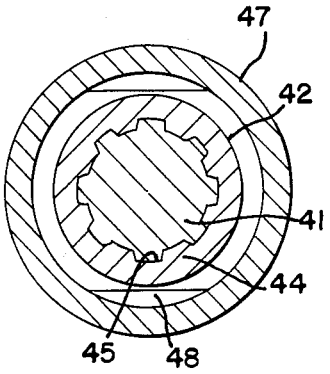
FIG. 5 is a sectional view taken on line 5—5 of FIG. 4.

As shown in FIGS. 4 and 5, the fore joint 42 includes a sleeve 44 having axial or straight splines 45 in its inner surface, the shaft 2 has straight or axial splines on its outer surface which engage the splines 45, and the adjacent end of the intermediate shaft 41 has speherical splines 46 on its outer surface in engagement with the axial splines 45. By spherical it is meant that the outer edges of the splines 46 have a spherical configuration when viewed in a plane passing through the axis of the shaft 41, thereby making the ends of each spline curved as shown in FIG. 4. Thus, the shaft 41 is coupled for angular movement relative to the sleeve 44 and the shaft 2. Formed between the sleeve 44 and an annular seal cover 47 are grease wells 48. This same coupling arrangement is also used for the aft joint 43, the splines of the shaft 41 having a spherical shape and the splines of the shaft 8 and the coupling sleeve 49 being straight or axial. Thus the shaft 41 can also move angularly relative to the shaft 8.

Figure 6:
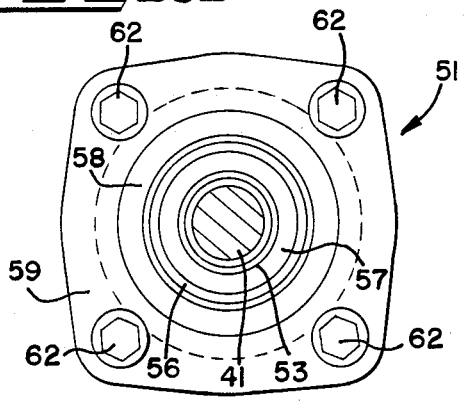
FIG. 6 is a sectional view taken on line 6—6 of FIG. 3.

As shown in FIGS. 3 and 6, the intermediate shaft 41 is supported by an intermediate bearing unit 51 on the bulkhead 3. The unit 51 includes a rubber sleeve 52 engaging the shaft 41, and fixed to the inside of an inner sleeve race 53. The race 53 is journaled by a needle bearing 54 supported within an outer race 55, which is fixed to the inside of an outer sleeve 56. Mounted between the inner race 53 and the outer sleeve 56 are a pair of seals 57. Secured as by a heat process to the outer periphery of the outer sleeve 52 is an elastic annulus 58 made of a resilient material such as rubber. Secured as by a heat process to the outer periphery of the annulus 58 is an annular metal flange 59 which has four peripheral holes 61 formed therethrough. The flange 59 is mounted on the bulkhead 3 by bolts 62 extending through the holes 61. Thus, the shaft 41 is resiliently supported by the bearing unit 51. The holes 61 have a larger diameter than the bolts 62 so that the flange 59 may be radially adjusted on the bulkhead.

A shaft cover 63 is fixed at its fore and aft ends respectively to the bulkhead 3 and the hull 28 (see FIGS. 1 and 3).

By the foregoing arrangement in accordance with this invention, even if the engine 1 is mounted out of the proper position with the crankshaft 2 offset from the intermediate shaft 41, the shaft 41 can adjust its position and angle in order to absorb the offset. This is also true of an offset of the impeller shaft 8. If the crankshaft 2 vibrates during engine operation, the vibration is absorbed and not transmitted through the sperical splines 46, the elastic sleeve 52 and the elastic annulus 58. The elastic support formed by the annulus 58 prevents loads produced when the crankshaft 2 vibrates from acting through the intermediate shaft 41 on the bearing unit 51 and the bulkhead 3, thereby improving the durability of the parts.

Interposed between the ends of the crankshaft 2, the intermediate shaft 41 and the impeller shaft 8 may be provided one or two rubber discs 64, although the discs 64 may be replaced by a gap or space.

What is claimed is:

1. A transmission for a small boat including a hull, an engine mounted on said hull, said engine having a crankshaft, and an impeller having an impeller shaft journaled by said hull, said transmission comprising an intermediate shaft adapted to be positioned between said crankshaft and said impeller shaft, a pair of coupling joints angularly movably connected to both ends of said intermediate shaft and adapted to be connected to said crankshaft and to said impeller shaft, bearing means connected to said intermediate shaft between the ends thereof, and resilient means connected to said bearing means and adapted to be mounted on said hull for elastically journaling said intermediate shaft on said hull for all directions of angular movement, and further including adjustment means attached to said resilient means and adapted to be attached to said hull for adjusting the position of said resilient means relative to said hull.

2. In a small boat including a hull, an engine mounted on said hull, said engine having a crankshaft, and an impeller having an impeller shaft journaled by said hull, the improvement of a transmission comprising an intermediate shaft positioned between said crankshaft and said impeller shaft, a pair of coupling joints angularly movably connected to both ends of said intermediate shaft and connected to said crankshaft and to said impeller shaft, bearing means connected to said intermediate shaft between the ends thereof, and resilient means connected to said bearing means and mounted on said hull for elastically journaling said intermediate shaft on said hull for all directions of angular movement, and further including adjustment means attached to said resilient means and to said hull for adjusting the position of said resilient means on said hull.

* * * * *